US005427009A

United States Patent [19]

LaPlante

[11] Patent Number: 5,427,009

[45] Date of Patent: Jun. 27, 1995

[54] HYDRAULIC DRUM TENSION/TUNING SYSTEM

[76] Inventor: Patrick R. LaPlante, 9160 Arpege Pl., Lake Worth, Fla. 33467

[21] Appl. No.: 891,944

[22] Filed: Jun. 1, 1992

[51] Int. Cl.[6] ..... G10D 13/02

[52] U.S. Cl. ..... 84/413; 84/419

[58] Field of Search ..... 84/419, 413

[56] References Cited

U.S. PATENT DOCUMENTS

| | | | |
|---|---|---|---|
| 3,541,913 | 11/1970 | Severino | 84/413 |
| 3,590,680 | 2/1970 | Carnes | 84/411 |
| 3,951,032 | 4/1976 | LaPorta et al. | 84/419 |
| 4,709,613 | 12/1987 | Powers et al. | 84/413 |
| 5,157,212 | 10/1992 | Fleming | 84/413 |

*Primary Examiner*—William M. Shoop, Jr.
*Assistant Examiner*—Jeffrey W. Donels
*Attorney, Agent, or Firm*—Ronald P. Kananen

[57] ABSTRACT

A hydraulic system for applying tension to musical drum heads. It consists of one or more master cylinders applying pressure to a hydraulic fluid in a sealed circuit. The master cylinders may be hand activated, foot activated, controlled by an external source, or a combination thereof. The hydraulic fluid is then forced through tubing to any number of reacting slave cylinders. The slave cylinders may be either single action (1 moving piston and seal) or dual action (2 moving pistons and seals moving in opposite directions), depending on the size and configuration of the drum. The pistons activate a mechanical lever or combination linkage that in turn pulls on a typical tension screw and rim configuration found on most common musical drums. The system allows for immediate pitch changes through the complete range of the drum while always maintaining uniform tension around the perimeter of each head. It also allows a fixed preset ratio between the tensions of the top and bottom heads on a two headed drum. The system includes a procedure for rapid change of heads with immediate tension balancing.

With the addition of a visual gauge to observe and repeat the fluid pressure in the hydraulic system, accurate pitches can be recalled no matter what source initiated the change.

27 Claims, 10 Drawing Sheets

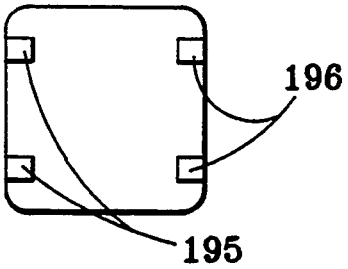
FIG. 11
FIG. 12
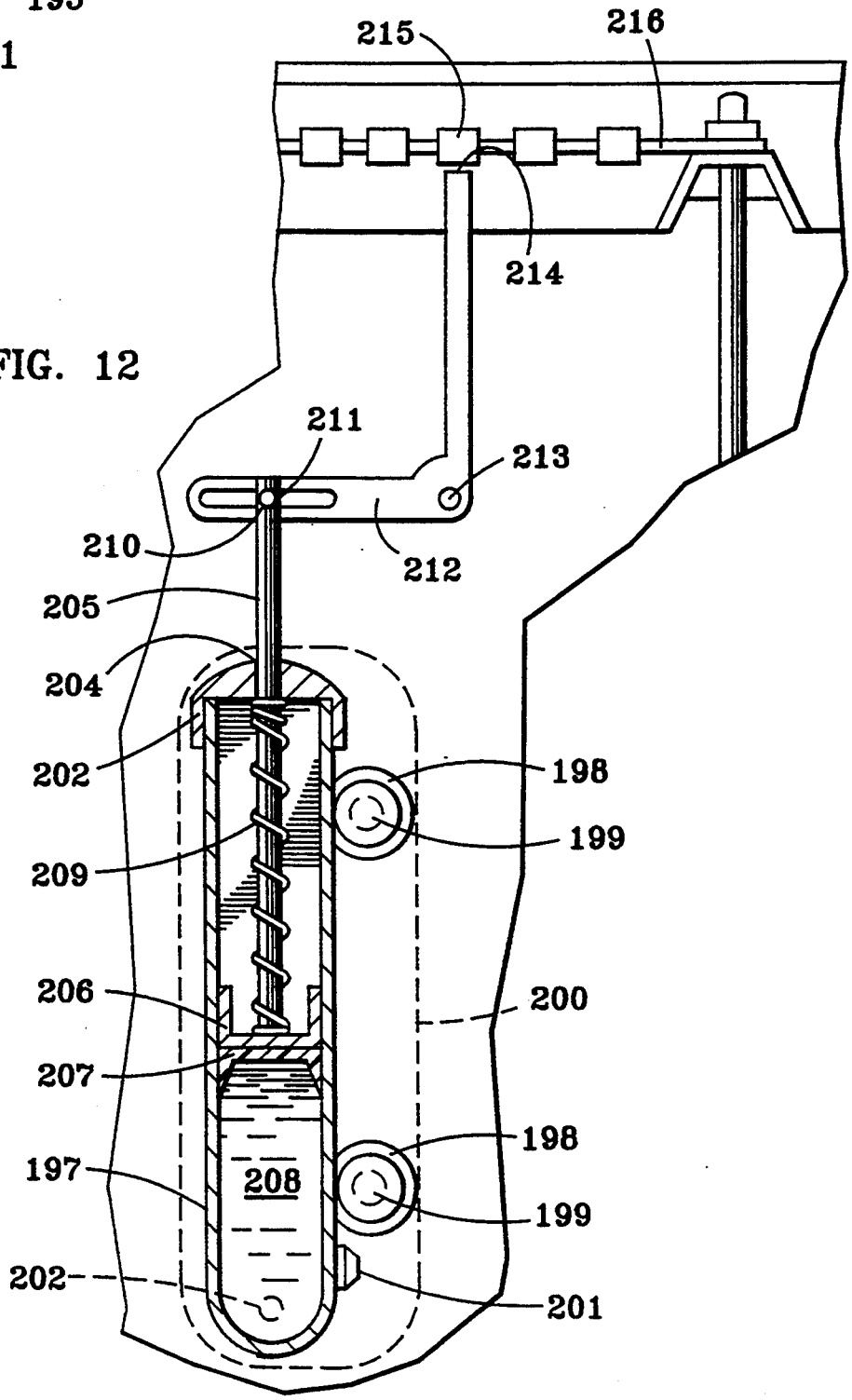

HYDRAULIC DRUM TENSION/TUNING SYSTEM

FIELD OF THE INVENTION

This invention relates in general to the different tensioning systems on musical drum heads and in particular to the systems allowing rapid tension and consequently rapid pitch (tuning) changes.

BACKGROUND OF THE INVENTION

The most common system for tensioning musical drum heads is simply a series of casings around the perimeter of the drum body, either fixed to the drum body itself, or to the opposing casing tensioning the opposite head. Each casing has an internally threaded socket into which a corresponding tension screw is threaded. The other end of the tension screw passes through a corresponding hole in the rigid pressure rim that pulls down on the metal, plastic or wood ring (counterhoop) that forms the perimeter of the head. The tension is generated by simply turning the screws in or out. The problem has always been that for a drum head to vibrate at its maximum, it must have equal tension in every direction. This has been a very slow and laborious process of continuously readjusting the screws until a fair approximation was achieved, and a perfectly balanced tension was rarely met. On drums where rapid pitch changes were to be made, as on timpani, an attempt to balance the tension was made through a floating tension base (as on the original European style Dresden timpani) that pulled on the screws directly, or through a spider linkage (as on William F. Ludwig style timpani). If only two opposing tension screws had been involved, this system would have worked. However because the systems include multiple (at least 6) screw sets, the result was a system that, when any other tension screw was adjusted, it effected all the other screws differently and often only confused the process.

Another problem is that because mechanical linkage is required, the controlling pedal must be in a fixed location on the drum. This at times keeps the pedal from being placed in the most desirable position.

Another design by Saul Goodman, used the typical tension screw means of manually balancing the tension. He then added a small sprocket to each screw and looped a continuous bicycle chain around the drum, engaging each of the individual tension screw sprockets so that all the screws could be turned equally. After initial balance was achieved it could be fairly well maintained. However drum heads have the property of becoming more stretched in the area where they are struck most frequently and one of the drawbacks of this system was that the ratio of the screws had to be frequently brought back into balance. Another problem is that to turn 6 or more tension screws at once, it takes considerable torque. Not only was this more difficult to do with one hand, but it also made the drum unstable with the torque of the single screw. To compensate he used 2 "T" handles instead of one. This allowed the moving of the chain with the hands in an opposed position necessary to keep the drum from moving or tipping over from the high torque required of one screw, but caused another problem. The user must be striking or causing the drum to vibrate by some means to ascertain the exact tension and consequently the pitch that the drum has reached. With two hands occupied in turning the handles, this becomes impossible. The user must alternate between striking the drum and turning the handles.

Another system devised is marketed as "Roto Toms" and has been limited to use on small drum heads. Because of the structure of the system, it has not been installed on any drum shell or timpani kettle. Without the amplification and resonance of a drum body, the vibrations coming from the bottom surface of the head tend to cancel out the vibrations from the top surface of the head leaving the sound thin, similar to a loudspeaker without an enclosure. The system consists of two very rigid rings that oppose each other and are mounted on a threaded rod by means of a rigid spider in the center each of the rings. By turning the entire assembly on the threaded rod, the rings move in relationship to each other, changing the tension applied to the head. At higher tensions, substantial leverage is again required to turn the mechanism. This tension system suffers from the same problems found in all the floating tension base systems. When any one screw is readjusted it moves the floating base, consequently changing the tension at every other screw to a different degree.

One final problem found in all the existing tension systems is that they all involve a lengthy process for changing the head. All the screws must be completely dissembled so the pressure rim can be removed. The head is then replaced, the pressure rim repositioned, the screws reinstalled and everything retightened and rebalanced. This makes it impossible to make any accurate comparison of different heads because by the time the next head is installed and balanced, the qualities of the previous head are impossible to remember exactly and compare.

None of the afore said systems achieves the benefits of this tuning system. That is, an automatic and constant perfect balancing of tension over the entire head, even when any of the individual tension screws are turned in or out. A light effort rapid tuning system that with the use of a small hydraulic hose allows unlimited placement of the adjusting pedal. A rapid process for changing and instantly bringing a newly mounted head into perfect tension balance.

SUMMARY OF THE INVENTION

A general object of this invention is to overcome the aforementioned and other drawbacks of the prior art and to achieve at least the aforementioned benefits.

The present invention is for a system of applying tension to musical drum heads which allows user with less experience to be able to perform with a greatly increased facility, and ever users with an accomplished technique in percussion to be able to greatly increase their accuracy and flexibility while drastically cutting their setup and maintenance time.

The system utilizes an individual hydraulically activated piston for each tension screw. Since the fluid is allowed to flow to all cylinders equally, the exact same pressure is achieved at all pistons. All the slave cylinders are of equal size so they produce equal pressure against the linkage and tension rods. No matter what is done to the system, as long as none of the pistons or linkages have reached the limits of their travel, all tension screws will be at equal pressure. The movement of the fluid compensates for all tuning screw positions or any stretching of the head. By adding a manually activated master cylinder to the fluid system, it makes rapid tension and therefore pitch changes possible. With the proper ratio of cylinder sizes, the hydraulic advantage (leverage) relieves much of the effort needed to activate the system. This allows less effort and one-handed tuning.

According to a further aspect of the present invention, with the addition of a pedal activated master cylinder linked to the fluid system through a flexible hose, the pedal can be placed wherever most convenient, and instant and accurate pitch changes can be made while still playing with both hands. With the addition of a gauge to measure the hydraulic pressure being maintained in the hydraulic circuit, another major advantage is realized. Prior to using the drum in performance, the performer sets the drum to each of the pitches required for the presentation and sets moveable visual markers on the gauge. This allows for the rapid and accurate recalling of any pitch needed, while continuously playing with the hands.

By installing a system on a drum that includes a hand operated master cylinder, a foot pedal operated master cylinder and a fluid pressure tuning gauge, several more advantages are attained. When the heel of the pedal is all the way down the drum is at its base pitch or lowest note, as are all pedal tuned drums. With the use of the hand operated master cylinder, this base pitch can be easily changed without detuning the drum. This is very difficult on all other pedal tuning systems. With the other systems the range of pitches it also limited by the amount of travel possible to the pedal. This system can easily lower the low notes and raise the high notes. This means that the entire range of notes on the drum are not limited to one full sweep of the pedal, consequently fewer notes are necessary on one sweep. By spreading the notes out farther on the sweep of the pedal, two more advantages are achieved. First, since the amount of pitch change of the head is less sensitive to the amount of movement of the pedal it becomes easier to be very particular about fine tuning the pitch. A one degree change in the pedal position creates a smaller change in the pitch. Secondly, there is a trade off between the distance the piston must move and the force needed to move it. A pedal that effects a pitch change of one note while traveling through 10° takes much less activating force than a pedal that attains the same pitch change in 5° travel. This requires less force from the counteracting springs to balance the hydraulic back pressure, resulting in a smaller, lighter pedal mechanism.

In a further aspect of the present invention, a two headed drum has its opposing heads tuned at different tensions to give the drum a different resonance characteristic. This system easily give 5 different top to bottom head ratios, while always maintaining the perfectly equalized tension around each individual head. By moving the tension rods to one of three holes in each tension lever, there are two ratios with the top head tighter, one with both heads the same and two more ratios with the top head looser.

According to another aspect of the present invention, by using a friction latch on the end of the tension rod that snaps into one of the three aforesaid tension lever holes, the possibility of a rapid change procedure for changing the heads is realized. All hydraulic pressure and consequently head tension is released with the hand screw master cylinder, then each of the snap in friction latches is popped out of its hole and the rod is swung aside. The head, the rim, the tension screws and rods are taken off the drum shell in one piece for any changes or adjustments necessary. The whole assembly is then replaced on the shell, the friction latches snapped back in and the balanced tension returned to the drum.

The basis of the system of the present invention is the unit containing the slave cylinder, tension lever and the tension rod. This unit can be made in any number of configurations depending on the particular situation requirement. Some different variations have been included in the extra figures. FIG. 10 shows an externally mounted hydraulic unit for use on a two headed drum while FIG. 14 shows the same tension unit for a single headed drum. FIG. 13 shows an internally mounted tension unit for a two headed drum, this configuration would be more appropriate for an initial installation on a new drum and could also come in a single headed model. The hand operated master cylinder and the tuning gauge could also be installed on the outside of the drum to simplify a retrofit installation on a standard drum. The entire system shown in the preferred embodiment has been designed to be either an initial installation on a new drum or a retrofit on an existing drum where the old head, rim and tension screws are reused and only the old screw casings are replaced with the new external tension units.

Finally, according to another aspect of the invention, all the tension units have been designed with limiting stops on the tension levers so that if for some reason the hydraulic pressure cannot be built up in the system the drum is still functional. The levers will close the gaps and the drum is tuned in the conventional manner by turning in the tension screws. A two headed drum can also be operated hydraulically with one of the heads removed because the tension lever for the removed head has a stop block or limiting gap that limits its travel.

BRIEF DESCRIPTION OF THE DRAWINGS

FIG. 11 shows the hydraulic tension unit cover from the back showing the arrangement of the mounting tabs.

FIG. 12 shows the cut away view of an externally mounted gauge with moveable pointer and adjustable visual indicators.

APPENDIX

Figure 1:
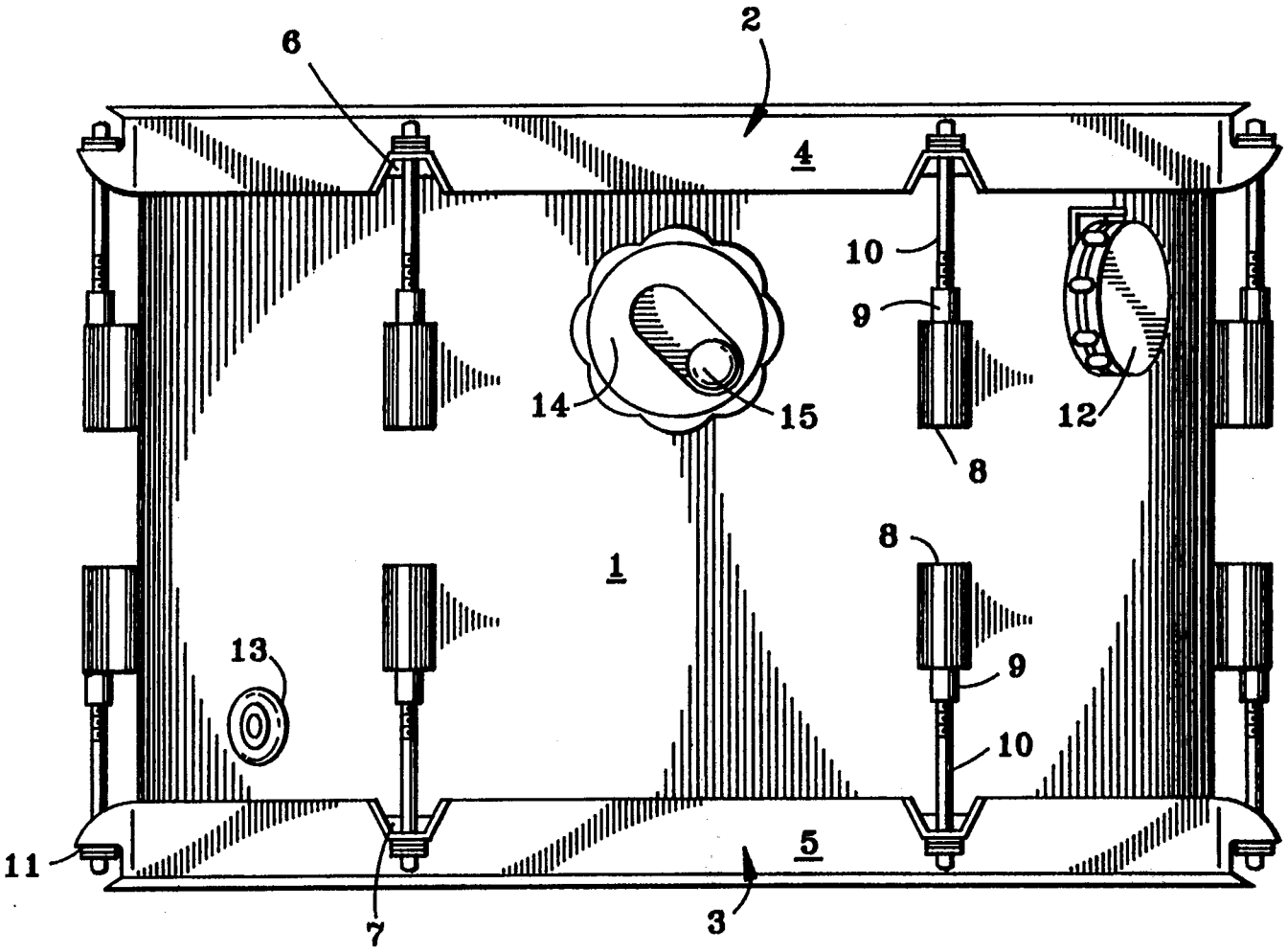
FIG. 1 shows a side view of a complete two headed drum. Shown installed on it are 8 covers for the hydraulic tension unit tension levers, an internal master cylinder operating knob, a hydraulic pressure tuning gauge and a fitting to connect an optional pedal operated master cylinder.

1. Drum body or shell.
2. Top membrane or head.
3. Bottom membrane or head.
4. Top pressure rim or hoop.
5. Bottom pressure rim or hoop.
6. Top head perimeter ring or counter hoop.
7. Bottom head perimeter ring or hoop.
8. Covers for the hydraulic tensioning units.
9. Tension rods.
10. Tension screws.
11. Acoustically dampening washers.
12. Optional hydraulic pressure activated tuning gauge.
13. Hydraulic hose fitting.
14. Internal master cylinder operating knob.
15. Operating nob crank handle.
16. Threaded rod.
17. Threaded rod bushing.
18. Two common nuts tightened together.
19. Slip washer.
20. Internal master cylinder end cap.
21. Internal master cylinder assembly.
22. Internally threaded sliding push rod.
23. Sliding push rod keying rib.
24. Sliding push rod guide ring.
25. Sliding push rod keying rib mating groove.
26. Piston.
27. Seal.
28. Hydraulic fluid.
29. Internal master cylinder fluid exit port.
30. Pipe extension.
31. Hydraulic fluid tubing fitting.
32. Hydraulic fluid tubing.
33. Internal master cylinder assembly mounting flanges.
34. Bolt.
35. Washer.
36. Nut.
37. Fluid chamber end of the internal master cylinder.
38. Threaded rod end of the internal master cylinder.
39. Hydraulic fluid bleeder screw.
42. Hydraulic tubing "T" fittings.
43. Compression or flange fittings.
44. Hydraulic tubing elbow fitting.
45. Pipe extension.
46. Fluid chamber.
47. Hydraulic tensioning unit slave cylinder.
48. Slave cylinder hydraulic fluid entrance port.
49. Slave cylinder seals.
50. Slave cylinder pistons.
51. Hydraulic tension unit pressure rods.
52. Pressure rod tension lever yoke.
53. Hydraulic tensioning unit tension levers.
54. Pressure rod pivot pin.
55. Tension lever pivot stud.
56. Friction reducing sleeve.
57. Pivot stud mounting holes.
58. Pivot stud mounting holes tabs.
59. Hydraulic tensioning unit backing plate.
60. Mounting bolts.
61. Slave cylinder mounting clamps.
62. Tension lever retracting spring.
63. Retracting spring holes.
64. Tension lever movement limiting gaps.
65. Maximum pressure-minimum movement adjustment hole.
66. Average pressure-average movement adjustment hole.
67. Minimum pressure-maximum movement adjustment hole.
68. Tension rod yoke for tension lever.
69. Snap in pin.
70. Fluid bleeder screw.
71. Tension lever limiting gap.
72. Tension lever cover hinge.
73. "U" shaped spring clip.
74. Foot pedal activated master cylinder assembly base plate.
75. Foot pedal activated master cylinder assembly side plates.
76. Screws.
77. Hole for footboard pivot shaft.
78. Hole for spring tension adjusting screw bracket.
79. Hole for foot pedal master cylinder shaft.
80. Footboard pivot shaft.
81. Footboard pivot bushings.
82. Foot pedal master cylinder footboard.
83. Footboard pivot lobes.
84. Footboard lobe for connecting pressure counteracting spring.
85. Hole for connecting pressure counteracting spring.
86. Foot pedal master cylinder pressure counteracting spring.
87. Toe end of footboard.
88. Pressure counteracting spring tension adjusting bracket.
89. Spring tension adjusting screw.
90. Spring tension adjusting screw bushing.
91. Spring tension adjusting screw bracket.
92. Spring tension adjusting screw head.
93. Spring tension adjusting screw bracket machined shaft ends.
94. Foot pedal master cylinder mounting shaft.
95. Foot pedal master cylinder body.
96. Foot pedal master cylinder body mounting lobe.
97. Bushing.
98. Circular spring clips.
99. Mater cylinder activating rod.
100. Master cylinder activating rod connecting eyelet.
101. Connecting shaft between footboard and cylinder activating rod.
102. Footboard lobes for activating master cylinder.
103. Foot pedal master cylinder assembly end cap.
104. Piston.
105. Seal.
106. Hydraulic fluid.
107. Master cylinder to hydraulic hose fitting.
108. Hydraulic fluid pressure hose.
109. Hydraulic pressure tuning gauge slave cylinder body.
110. Tuning gauge slave cylinder mounting flanges.
111. Bolt and nut assemblies.
112. Tuning gauge backing plate.
113. Hydraulic fluid bleeder screw.
114. Hydraulic fluid entrance port.
115. Hydraulic tubing fitting.
116. Tuning gauge slave cylinder body end cap.
117. Keyed push rod guide hole.
118. Turning gauge slave cylinder keyed push rod.
119. Piston.
120. Seal.
121. Hydraulic fluid.

122. Turning gauge compression spring.
123. Rack of gear teeth machined into keyed push rod.
124. Indicator mounting shaft pinion gear.
125. Indicator mounting shaft.
126. Indicator mounting shaft bushing.
127. Rotating indicator mounting disk.
128. Indicator disk groove to install visual markers.
129. Manually adjustable visual markers.
130. Fixed visual marker pointer.

EXTERNAL SYSTEM

131. Drum body or shell.
132. Top membrane or head.
133. Bottom membrane or head.
134. Top pressure rim or hoop.
135. Bottom pressure rim or hoop.
136. Hydraulic tension unit covers.
137. Tension rods.
138. Tension screws.
139. Acoustically dampening washers.
140. External "T" handle operated master cylinder cover.
141. External master cylinder.
142. Sliding push rod for external master cylinder.
143. "T" handle.
146. Piston.
147. Seal.
148. Hydraulic fluid
149. Fluid exit port.
150. Pipe extension.
151. Fluid tubing elbow.
152. Hydraulic tubing.
153. External handled master cylinder backing plate.
154. Nut and bolt assembly.
155. Master cylinder mounting flanges.
156. Bleeder screw.
157. "T" handle mounting bracket.
158. Friction reducing bushing.
159. Spring circle clips.
160. Master cylinder end cap.
161. Top read edge of external master cylinder cover.
162. Master cylinder cover mounting tabs.
163. Cover mounting screw.
164. Hydraulic tubing "T" fitting.
165. Compression or flange tubing fittings.
166. Fitting elbow.
167. Pipe extension.
168. Externally mounted hydraulic tension slave cylinder.
169. Slave cylinder entrance port.
170. Cylinder seal.
171. Piston.
172. Tension lever.
173. Tension lever pivot stud.
174. External tension unit backing plate.
175. Pivot stud mounting screw.
176. Washer
177. Pivot stud locking nut.
178. Tension lever movement limiting gaps.
179. Tension lever offset bend.
180. Maximum pressure-minimum movement adjustment hole.
181. Average pressure-average movement adjustment hole.
182. Minimum pressure-maximum movement adjustment hole.
183. Tension rod 90° angled shaft.
184. Snap in friction knob.
185. Tension lever retracting spring.
186. Retracting spring mounting holes.
187. Bleeder screw.
188. Hydraulic unit cover retaining spring.
189. Slave cylinder mounting flanges.
190. Bolt and nut assembly.
191. Stop block mounting holes.
192. Tension lever movement limiting stop blocks.
193. Unit cover mounting tab receiving slots for 195.
194. Unit cover mounting tab receiving slots for 196.
195. Longer unit cover mounting tabs.
196. Shorter unit cover mounting tabs.
197. Externally mounted hydraulic pressure tuning gauge slave cylinder.
198. Slave cylinder mount eyelets.
199. Bolt and but assembly.
200. External tuning gauge backing plate.
201. Bleeder screw.
202. Fluid entrance port.
203. Slave cylinder access end cap.
204. Keyed guide hole.
205. Keyed push rod.
206. Piston.
207. Seal.
208. Hydraulic fluid.
209. Compression spring.
210. Internally threaded hole.
211. Screw with rolling sleeve.
212. External tuning gauge "L" shaped lever.
213. "L" shaped lever pivot bolt.
214. "L" shaped lever pointer.
215. Manually adjustable visual indicators.
216. Mounting track for visual indicators.
217. Indicator track mounting tabs.
218. External mounted gauge cover.

DETAILED DESCRIPTION OF THE PREFERRED EMBODIMENTS

For the purpose of promoting an understanding of the principles of this invention, references will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
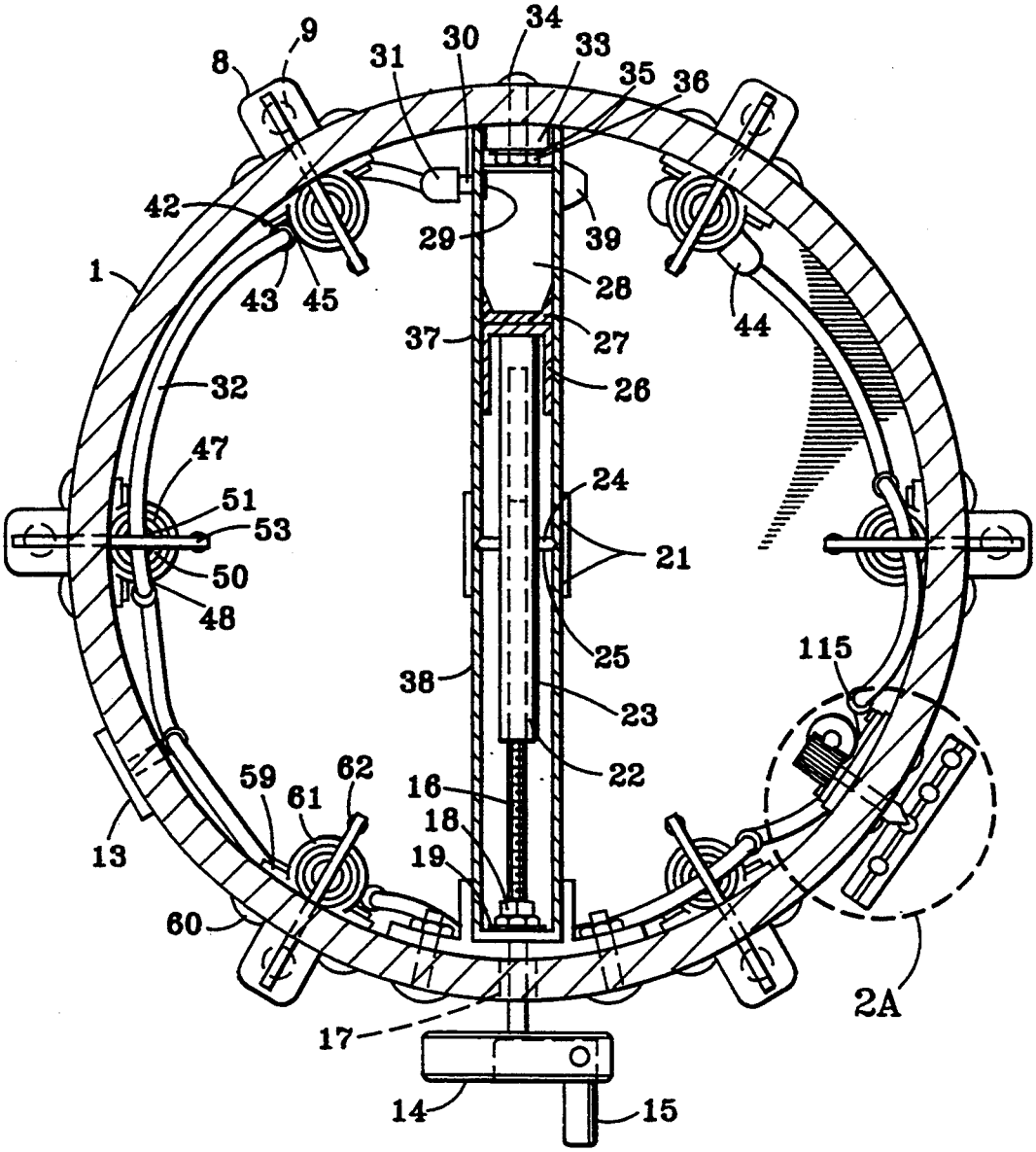
FIGS. 2 and 2A show a cutaway section from above the drum shell showing the internal master cylinder and the top view of the individual hydraulic tension units.
Figure 2A:
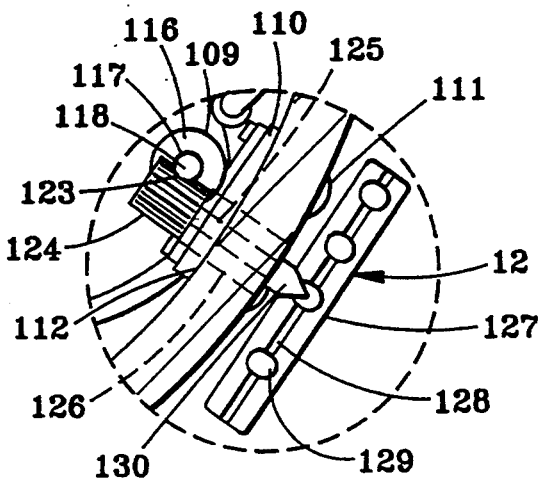

Referring to FIG. 1, there is an illustration of a two headed musical drum consisting of a shell 1, a top head 2 and a bottom head 3 and their corresponding pressure rims 4,5 pulling on the head counter hoops 6,7. Mounted around the outside perimeter of the shell can be seen the removable covers 8 of the hydraulic tensioning units with their respective tensioning rods 9 extending toward each pressure rim. Through corresponding holes in the rim and screwed into the internally threaded end of the tension rods are the tension screws 10 pulling the pressure rim onto the drum shell and thus stretching the head membrane over the resonating cavity of the drum shell. Acoustically dampening washers 11 help isolate the vibration of the heads from the mechanism. Also mounted on the outside of the drum shell is the optional hydraulic pressure activated tuning gauge 12 and the hydraulic hose fitting 13 enabling the control of the hydraulic fluid pressure in the circuit by an external means. This makes it possible to connect a pedal activated master cylinder to the system. Also shown on the outside of the shell is the internal master cylinder operating knob 14. A fold out crank handle 15 has been installed to facilitate rapid operation of the cylinder. This crank handle could be replaced by a deep blind hole in which the end of a drum stick may be inserted to rotate the knob, thereby enabling the user to keep drum sticks in both hands. The knob is fixed to the end of a threaded rod 16 (see FIGS. 2 and 2A). The threaded rod passes through a bushing 17 in the shell and into the internal master cylinder assembly. It is kept from pushing out of the assembly by two common nuts 18 locked together and a slip washer 19 that relieves binding under tension as it presses against the inside of the end cap 20 that is fitted onto the end of the master cylinder assembly body 21. Inside the assembly, the threaded rod screws into an internally threaded sliding push rod 22. The sliding push rod has a keying rib 23 along one side and passes through a guide ring 24 with a groove 25 that mates with the keying rid. This keeps the sliding push rod from rotating, so that when the knob and threaded rod are rotated, the sliding push rod is forced back and forth inside the internal master cylinder assembly. As the sliding push rod is forced away from the knob end of the threaded rod, it pushes the piston 26 and seal 27 thereby compressing the hydraulic fluid 28 and forcing it through the exit port 29, pipe extension 30, fluid tubing fitting 31 and out to the rest of the sealed hydraulic system through the hydraulic tubing 32. The internal master cylinder consists of a single tube shorter than the interior diameter of the drum shell. It is held in place by two tab flanges 33 on each end of the tube. Each flange had a typical bolt 34, washer 35, and nut 36 assembly fastening it to the drum shell. A suitable position for the sliding push rod guide ring has been selected to allow the full operational length of the sliding push rod itself. At this point, the master cylinder assembly body has been separated into two pieces, the fluid chamber end 37, and the threaded rod (16) end 38. These two ends may be fastened together by threading one into the other, a bayonet mount or a slip joint that can be locked together. This allows access to the interior of the cylinder assembly. The sliding push rod guide ring is shaped in such a way that it is clamped in place when the two master cylinder body fittings are tightened together. The internal master cylinder is fitted with a typical blood screw 39 through which fluid can be introduced to fill and purge the system of air.

Figure 3:
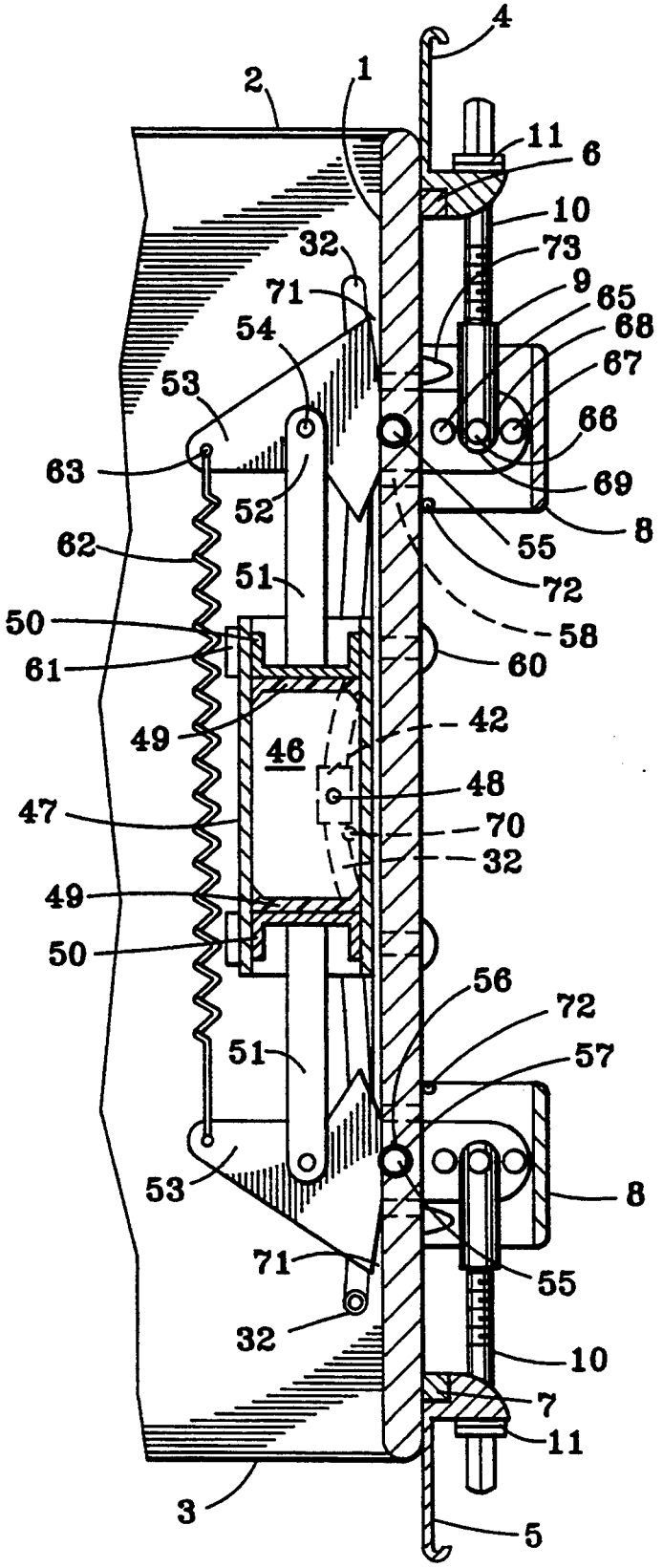
FIG. 3 shows the cutaway side view of one of the internal hydraulic tension units.

When the pressurized fluid leaves the internal master cylinder it travels through the tubing fitting and connecting hydraulic pressure tubing around the inside of the drum shell through the entire hydraulic circuit. It passes through a pipe "T" 42 next to each hydraulic unit and then on to the remainder of the system. Thus it enters each slave cylinder equally. The tubes are connected with either compression fittings or flange fittings 43. The last cylinder on the line has been fitted with an elbow 44 so that air can not come back to the internal master cylinder when purging the system. The center opening of each "T" fitting has a pipe extension 45 screwed into it and completes the hydraulic passage into the chamber 46 inside the hydraulic tension unit slave cylinder 47 (see FIG. 3). The pressurized fluid enters the slave cylinder through the entrance port 48 and presses outward with equal pressure on both seals 49 and pistons 50. As these pistons push out, they press on and move the hydraulic tension unit pressure rods 51. The end of the pressure rod farthest from the piston is split into a yoke 52 between which fits the tension 53 lever and is mechanically connected with a pivot pin 54. As the pressure rod moves up and down, it rotates on the tension lever pivot stud 55. The tension lever pivot hole is lined with a friction reducing sleeve 56. The ends of the pivot stud are fixed in two corresponding holes 57 drilled in two matching tabs 58 cut into the slave cylinder backing plate 59. Each tab has a 90° bend away from the cylinder side and fits into a large hole drilled in the drum shell. The slave cylinder body is fastened by bolts 60 through pipe strap style clamps 61. When a cast cylinder body is used, mounting eyelet tabs would be part of the casting. The bolts continue through the tension unit backing plate and on through the shell of the drum, clamping the whole assembly to the drum body. Very little pressure is placed on the mounting clamps in the two headed configuration, but when used in the single headed configuration and one end of the slave cylinder was blocked off to replace one of the pistons, the cylinder body mounting would have to be of sufficient strength to support enough pressure to counteract the push of the pressure rod on the other end of the cylinder. A tension lever retracting spring 62 fastens into a hole 63 in each of the opposing tension levers and keeps the entire mechanism pressed against the hydraulic fluid.

The limiting gaps 64 are important in that during an emergency case when hydraulic pressure can not be applied, the tension screw may be screwed into the tension rod 9 until the gap is closed and the drum can be tuned in the conventional nonhydraulic manner.

The tension lever is very rigid and has a choice of three holes 65,66, or 67 in which the tension rod may be connected. The hold 65 nearest to the pivot stud produces the greatest force transferred to the tension rod with an equal amount of pressure in the cylinder. Hole 66 produces a lesser force than hole 65 and hole 67 produces the least force on the tension rod. This is important because it allows five different ratios of top head to bottom head tension, one with equal tension to top and bottom heads, two with the top head tighter and two with the bottom head tighter. These ratios remain the same as long as the hole that is used is not changed around the perimeter of each individual head. This allows each head to remain in perfect balance with itself while being different from the other head on the same drum. The tension rod 9 ends in a yoke 68 that fits on both sides of the tension lever and, with a use of a snap in pin 69 passing through the selected tension lever hole, pulls on the tension rod. This allows rapid changing of the head. All tension is released using the master cylinder. The snap pins are pulled out and the tension rod, tension screw and pressure rim are removed. The head is changed and the assembly is replaced. The snap pins are reinserted and the balanced tension is reapplied to the head by the master cylinder.

The other end of the tension rod has been internally threaded to mate with a conventional tension screw 10. The tension screw then passes through a corresponding hole in a conventional pressure rim 4 and pulls the rim and the head counter hoop 6 over the drum shell consequently applying tension to the head. The tension screw into the tension rod has remained adjustable so that under extreme head conditions, the hydraulic tension units can all be kept in their free floating range. The slave cylinder has been fitted with a standard automotive type bleeder screw 70 to purge air from each cylinder in successive order from the master cylinder to the last cylinder on the end of the line.

The tension lever movement limiting gap 71 not only keeps the piston from being pushed out of the cylinder by the hydraulic pressure, but it also allows a two headed configuration to be operated with full hydraulic balancing when only one head installed. This is desirable in some instances.

Optional tension lever covers 8 have been mounted in this configuration. They have a hinge 72 at the end farthest from the tension rod entrance slot. Under the opposite end of the cover, a "U" shaped spring clip 73 is fastened to the drum shell with a screw through the center. When the cover is pressed tightly into a closed position, the spring clip presses outward against the inner surfaces of the cover. The two opposing tabs of the spring clip each has a small rounded point that fits into a mating notch on the inside of each side of the cover interior. This allows easy access to the mechanism and insures against cover loss, while the spring tension inhibits rattling from the vibration of the drum.

Figure 10:
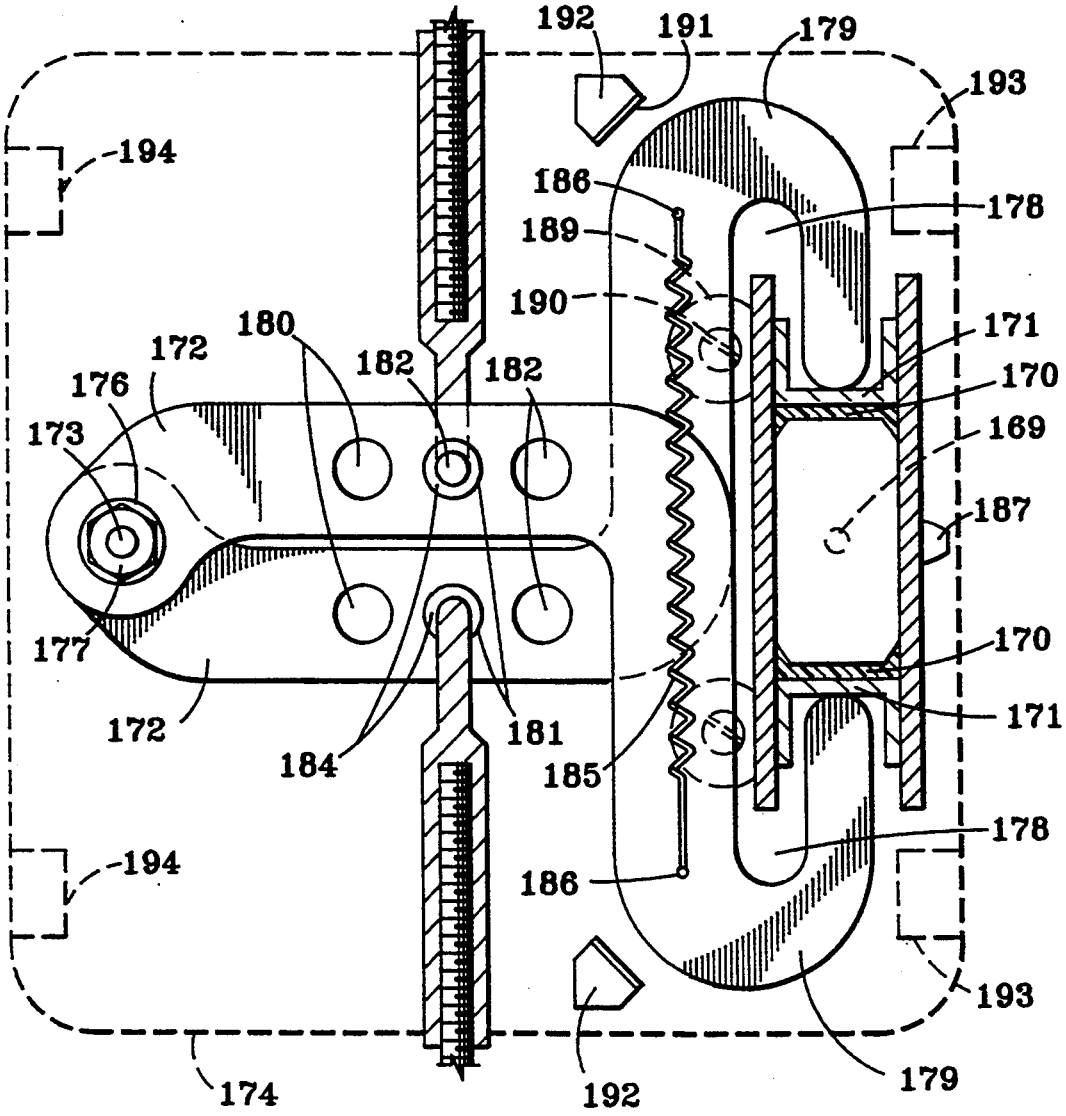
FIG. 10 shows an externally mounted hydraulic tension unit assembly.

This system would basically be an initial installation on a new drum. For a simpler installation to retrofit an existing drum, an external hydraulic tension unit has also been designed for both one and two headed drums (see FIGS. 10 and 14). A complete description of the external system for a two headed drum is included at the end of this section. The tension units in these retrofit installations simply replace the existing tension screw casings on the outside of the original drum. A possible conversion kit for timpani could include the addition of the hydraulic tension units (slave cylinders), a hand activated master cylinder and a foot operated master cylinder that could be operated by the existing pedal and balance spring mechanism. All the advantages of the hydraulic tuning system would be realized except the flexibility of the placement of the pedal.

Figure 4:
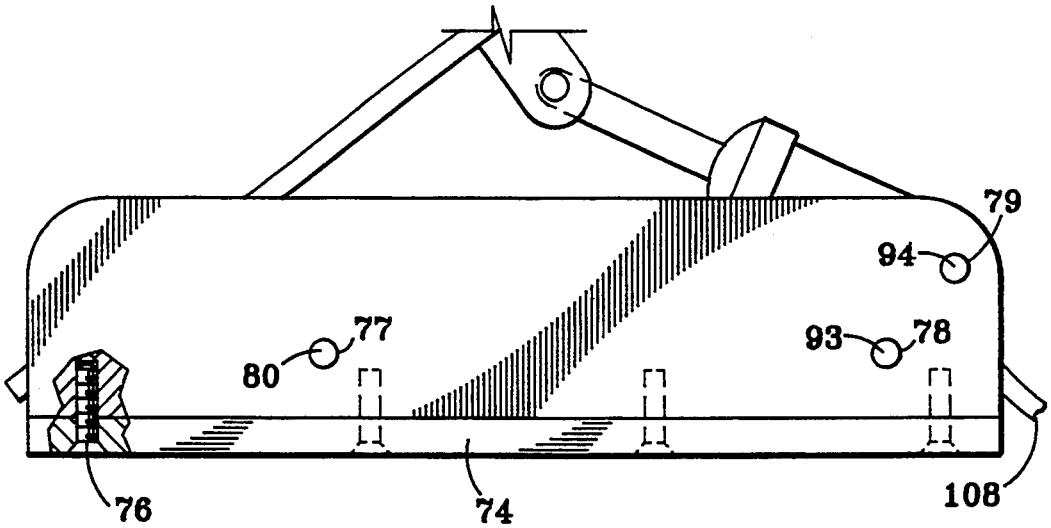
FIG. 4 shows the side view of the foot pedal.
Figure 5:
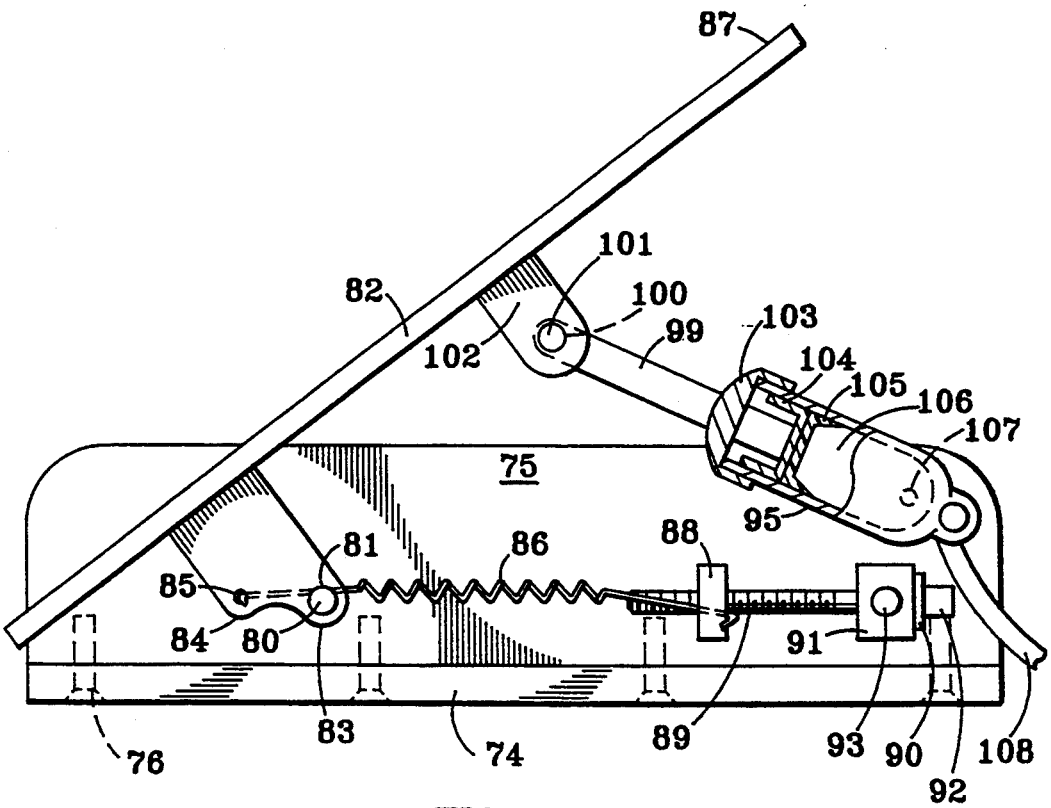
FIG. 5 shows the side view of the foot pedal with the side cover removed.

The complete system may be used as described above, however in some cases the addition of a foot pedal to change hydraulic pressure in the system is desirable. The internal master cylinder would be maintained as a means to adjust the range of tensions available to the pedal (see FIG. 4). The pedal consists of a base plate 74 which holds two side plates 75 in place by use of screws 76 that go up through holes that are drilled along the side edges of the base plate. The screws then continue up into internally threaded holes in the bottom edges of the side plates. The side plates in turn hold the entire mechanism in place. Three holes 77, 78, and 79 are drilled into each side plate. Hole 77 holds the ends of the shaft 80 which goes through the two bushings (see FIG. 5) 81 that fit into the holes in the foot board 82 pivot lobes 83. On the footboard pivot lobe is a secondary lobe 84 that has a hole 85 in which is hooked the end of the pressure counteracting spring 86. When the heel of the foot board is all the way down hole 85 is situated near the extension of a straight line drawn between the center axis of the footboard shaft and the tension point at the other end of the pressure counteracting spring. In this position very little tension from the pressure counteracting spring is exerted torsionally on the footboard pivot lobe, and there is little tension trying to pull the toe 87 of the foot board down. As the foot board toe is pushed down, progressively more tension is brought to bear from the spring because of the increasing effective distance that the spring tension point raises above the line of the foot board pivot shaft. With proper spring size and adjustment the back pressure of fluid in the cylinder from the tension of the drum head can be compensated and remain static in any position. The other end of the pressure counteracting spring is hooked through a hole in the spring tension adjusting bracket 88. The spring tension bracket is a rigid piece of material with a small hole in each end into which hooks the opposite end of each of the two pressure compensating springs, one on each side of the pedal. In the spring tension bracket's center is a threaded hole into which screws the spring tension adjusting screw 89. The spring tension adjusting screw is held in position as it passes through a bushing 90 that is held in place by the spring tension adjusting screw bracket 91. The spring tension adjusting screw ends with a nonstandard head 92 which mates with a separate adjusting wrench that resists unauthorized tampering with the adjustment. In addition to the bearing mounting hole in the center of the spring tension adjusting screw bracket, the left and right ends of the bracket have been machined to form a shaft 93 that fits in the hole 77 that has been drilled into the foot pedal side plate. This allows the spring tension adjusting screw and the pressure compensating spring to swivel slightly as the foot board is moved up and down. The last hole 78 drilled into the side plate holds the foot pedal master cylinder mounting shaft 94. The foot pedal master cylinder 95 has an integral lobe 96 formed on the mounting end of it. A hole is drilled through this lobe and carries a bushing 97 that fits on the foot pedal master cylinder shaft. The lobe and consequently the master cylinder itself are kept at the midpoint of the shaft by circular spring clips 98 riding in grooves cut into the shaft on each side of the lobe. The master cylinder activating rod 99 has a eyelet 100 on the foot board end of it. A shaft 101 goes through this eyelet and continues on in both directions to mate with two foot board master cylinder activating lobes 102. One lobe on each side of the food pedal master cylinder activating rod. The other end of the foot pedal master cylinder activating rod passes through a hole in the master cylinder end cap 103 which is threaded onto the end of the foot pedal master cylinder body. Unscrewing this end cap gain access to the interior of the cylinder. Inside the cylinder, the activating rod pushes on the piston 104, the seal 105 and consequently compresses the hydraulic fluid 106. The fluid is then forced out through the fitting 107 and passes through the pressure hose 108 and on to the drum. It may be a fixed hydraulic coupling or a quick connect fitting 13 that passes through the shell of the drum and consequently ties the hydraulic fluid in the hose to the hydraulic circuit in the interior of the drum.

Figure 6:
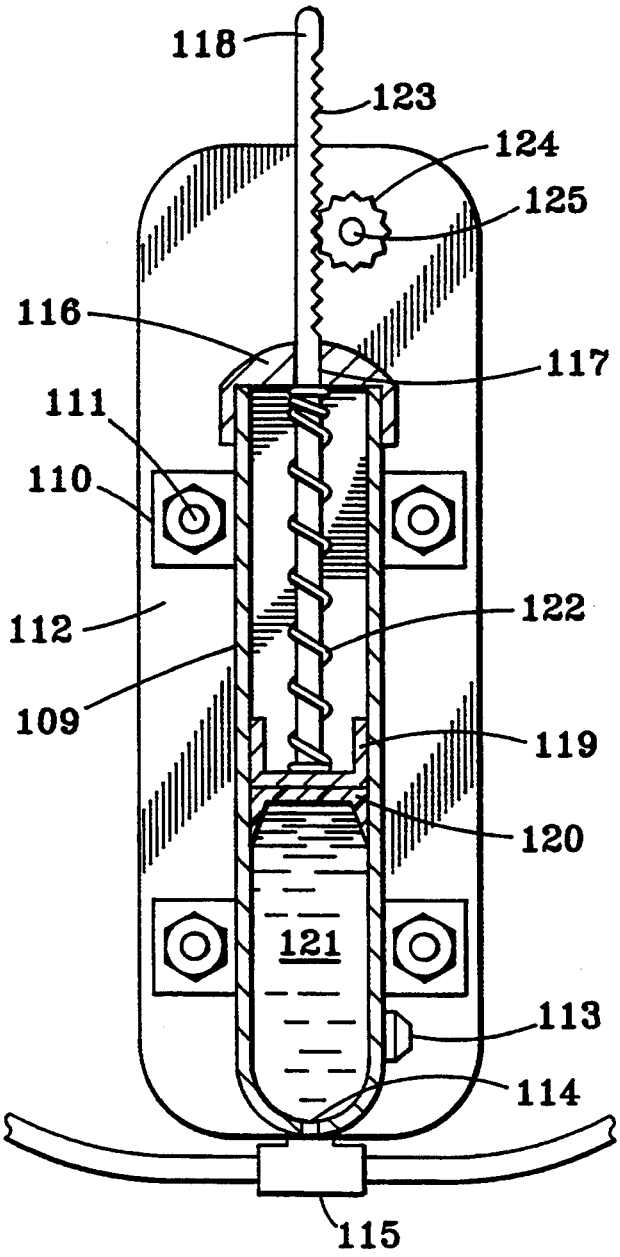
FIG. 6 shows a cutaway view of the internally mounted pressure activated turning gauge slave cylinder.

In most cases it would be desirable to be able to recreate the pressure and consequently the pitch setting of the drum repeatedly on command. For this reason, a pressure sensitive gauge has been devised with adjustable markers. The gauge consists of a slave cylinder body 109 (see FIG. 6) that is held in place either with integral eyelet flanges cast 110 onto the cylinder or pipe style straps. Bolts 111 pass through the eyelets, through the backing plate 112 and on through the drum shell holding the entire unit in place. The cylinder has a bleed screw 113, and a fluid entrance port 114 that is threaded to accept the hydraulic tubing fitting 115. The hydraulic fluid connection can be made anywhere in the circuit as long as all cylinders remain in a straight line with no loops created. The system must be purged from one end of the circuit to the other filling each successive cylinder in order. The cylinder assembly has a thick end cap 116 that is threaded onto the cylinder body and has a keyed guide hole 117 that the keyed push rod 118 slides through. The internal end of the push rod is fastened to the piston 119 which in turn presses on the seal 120 and consequently compresses the fluid 121 in the chamber. Inside the cylinder between the end cap and the piston is a compression spring 122 against which the changing fluid pressure pushes. The upper end of the sliding push rod has a rack of gear teeth 123 machine into the side of it. This rack of gear teeth engages a pinion gear 124 that is mounted on the end of a shaft 125 that goes through a bushing 126 mounted in the wall of the drum shell. On the end of this shaft that sticks out of the drum is a disk 127 (see FIG. 2) that is fixed to the shaft and rotates with it. A deep groove 128 is cut around the circumference of the disk. Carpet tack shaped visual indicators 129 can be snapped into the groove at any point. The indicators fit tight enough so that they can only be removed by prying them out with a screw driver or other lever. A pointer 130 is mounted on the drum shell in a position so that it just clears the indicators as the disk is rotated. As the pressure in the hydraulic circuit changes, the tuning gauge disk and visual markers rotate allowing the pressure and consequently the head tension and tuning to be accurately recalled upon demand.

EXTERNALLY MOUNTED HYDRAULIC TENSION UNIT

Figure 7:
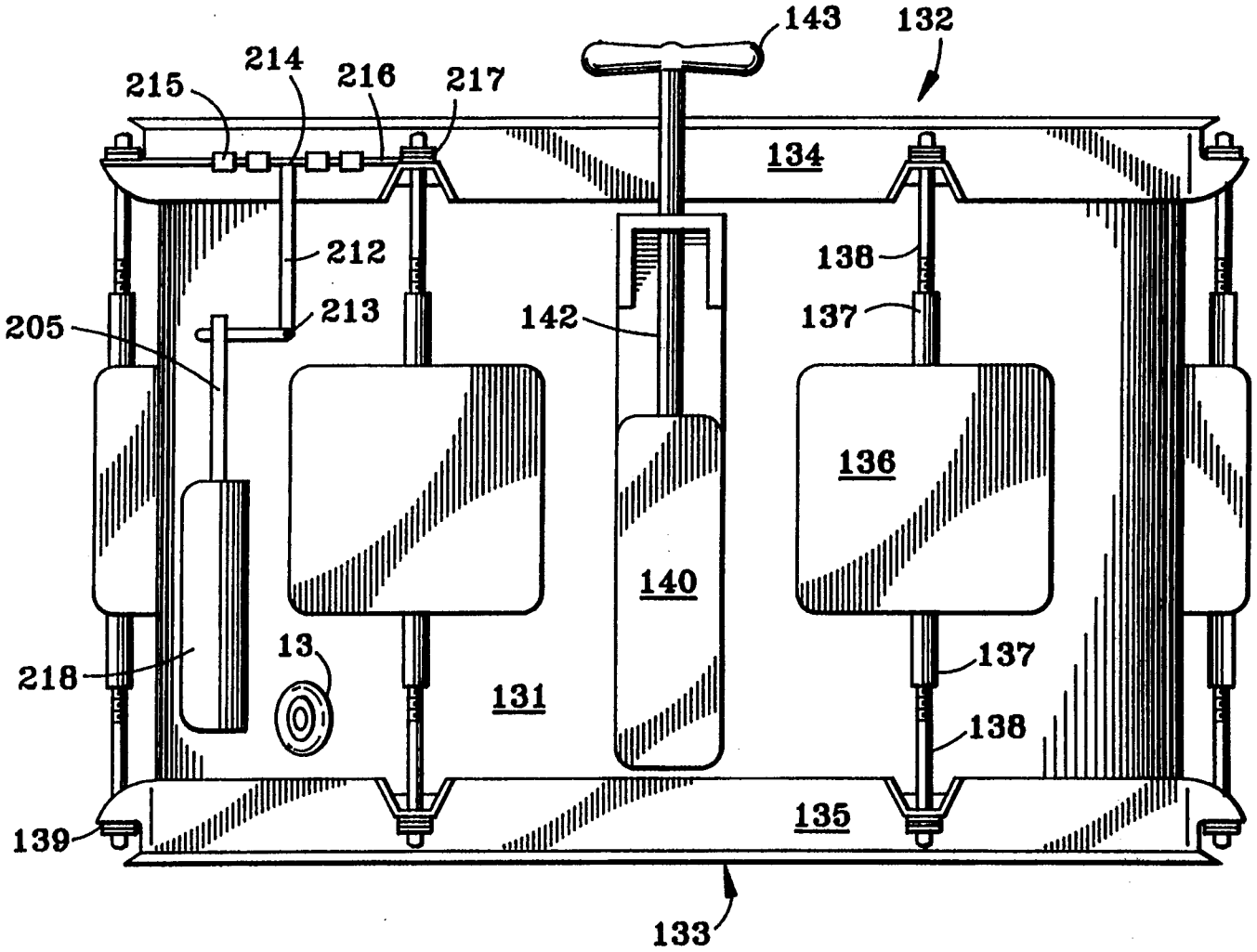
FIG. 7 shows the side view of a two headed drum with externally mounted hydraulic tension system.

To demonstrate the scope of the hydraulic system in general, and to clarify operation of the externally mounted hydraulic tension system, a description of the configuration has been included (see FIG. 7). This side view of a drum with external hydraulic tension units also shows an externally mounted hand operated master cylinder with a "T" handle and an externally mounted hydraulic pressure tuning gauge with a moving pointer and adjustable pitch markers.

Figure 8:
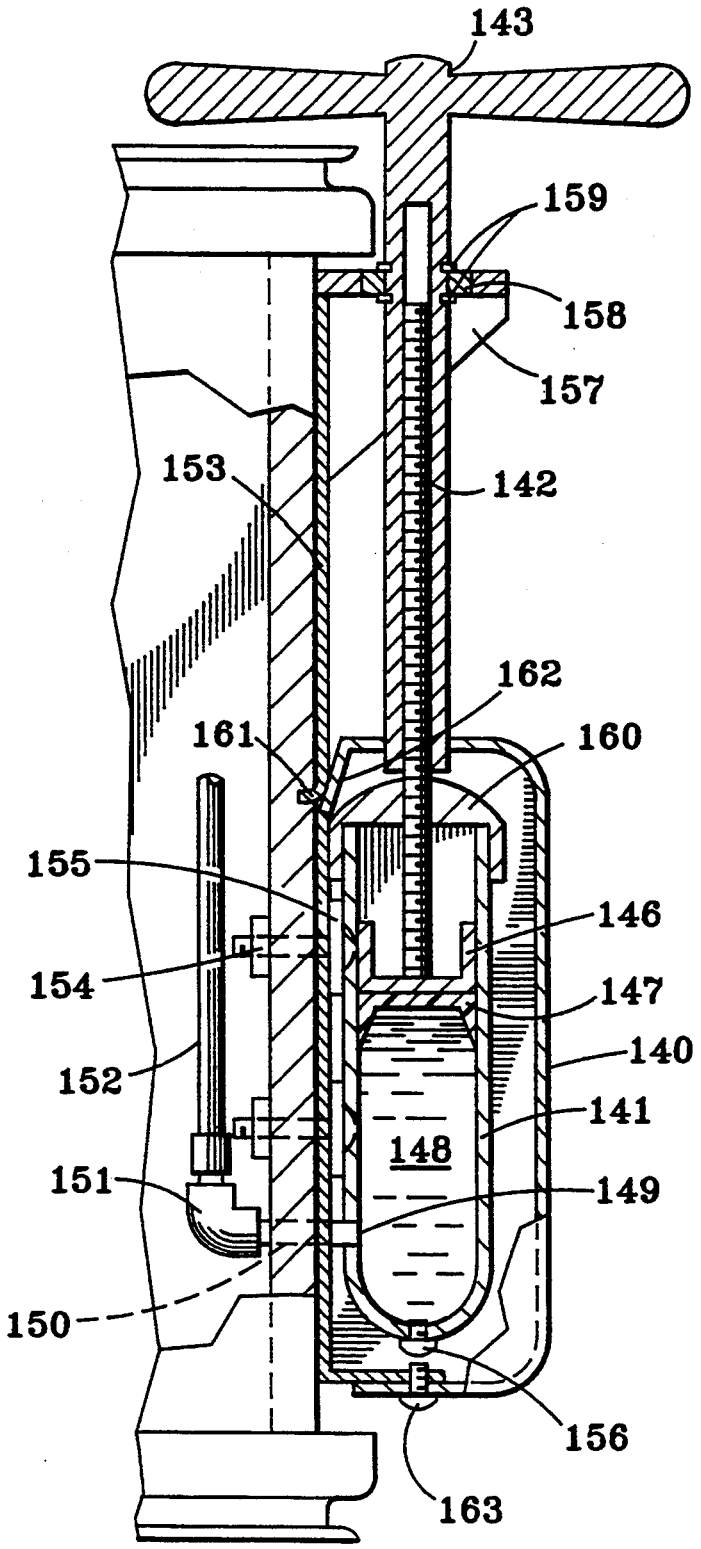
FIG. 8 shows a cutaway view of an externally mounted "T" handle operated master cylinder.

The figure shows a two headed musical drum consisting of a shell 131, a top head 132 and a bottom head 133 and their corresponding pressure rims 134, and 135. Mounted around the outside perimeter of the shell can be seen the removable covers of the hydraulic tensioning units 136 with tensioning rods 137 extending toward each pressure rim. Through the holes in the rim and into the internally threaded end of the tension rods are the tension screws 138 pulling the pressure rim onto the drum shell and thus stretching the head membrane over the resonating cavity of the drum shell. Acoustically dampening washers 139 help isolate the vibration of the head from the mechanism. Also mounted on the outside of the shell is the cover 140 for the "T" handled master cylinder 141 with the sliding push rod 142. Threaded into the end of the sliding push rod is the threaded "T" handle screw 143. By turning the "T" handle, the threads force down the sliding push rod (see FIG. 8), which presses down on the "T" handle master cylinder piston 146 and seal 147 thereby compressing the fluid 148 forcing it through the exit port 149, pipe extension 150, fluid tubing elbow 151 and out to the rest of the sealed hydraulic system through the hydraulic tubing 152. The "T" handle master cylinder is fastened through the backing plate 153 and through the drum shell using bolts and nuts 154 through integral flanges 155 on the cylinder casting. The "T" handle is fitted with a typical bleed screw 156 through which fluid can be introduced to fill and purge the system of air. The backing plate extends up to secure and position the "T" handle bracket 157. The "T" handle bracket has a hole in which a friction reducing bushing 158 is mounted, through which the "T" handle screw goes and is held from going up or down by spring clips 159 that rid in grooves around the circumference of the "T" handle screw shaft. A large cap 160 with a keyed guide hole that the keyed sliding push rod 118 slides through is threaded onto the top of the cylinder. The "T" handle master cylinder cover 140 is held in place by inserting the top rear edge of the cover at 161 on both sides of the sliding push rod behind the two tabs 162 that are bent forward on the backing plate. The cover is then pulled down by tightening a screw 163 into the bleeder screw on the bottom of the "T" handle master cylinder.

Figure 9:
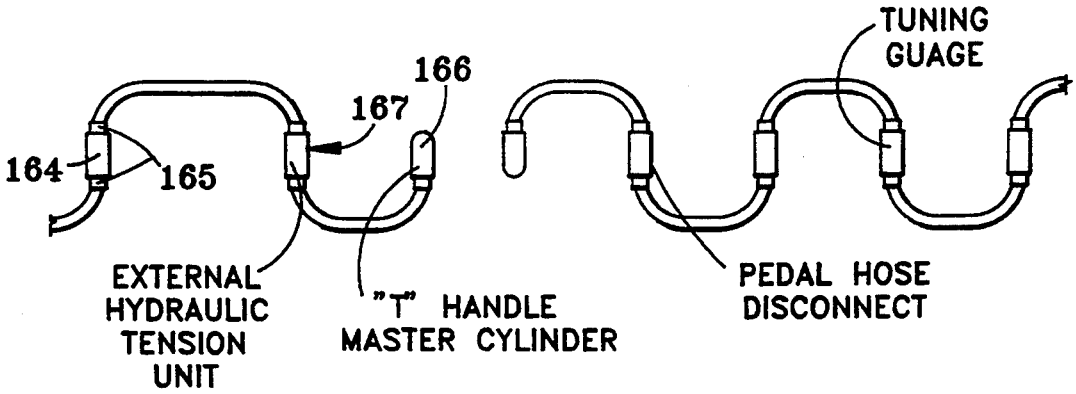
FIG. 9 shows the internal rounting of the hydraulic tubing around the inside of the drum shell.

When the pressurized fluid leaves the external master cylinder it travels through the tubing fitting and around the inside of the drum shell (see FIG. 9) through the entire hydraulic circuit. It passes through a pipe "T" 164 behind each tension unit and thus into each slave cylinder equally. The tubes are connected with either compression fittings or flange fittings 165. The last cylinder on the line has been fitted with an elbow 166 so that air can not come back to the internal master cylinder when purging the system. The center opening of each "T" fitting has a pipe extension 167 screwed into it and passes through the drum shell with the other end screwed into the back of the slave cylinder 168 (see FIG. 10). The pressurized fluid enters the slave cylinder through the entrance port 169 and presses outward with equal pressure on both seals 170 and pistons 171. As these pistons push out, they press on and move the tension levers 172 which rotate on the pivot stud 173. The pivot stud is fastened to the backing plate 174 with a screw 175 through the back. The stud has a wider diameter shoulder between the tension lever and the backing plate to maintain a space that keeps the movement of the tension levers away from the backing plate. The pivot stud, the tension levers and the keeper washer 176 are all isolated from each other with friction reducing bushings and friction reducing washers. On the end of the pivot stud is a locking nut 177 to hold everything in place.

The limiting gaps 178 are important in that during an emergency case when hydraulic pressure can not be applied, the tension screw may be screwed into the tension rod until the gap is closed and the drum can be tuned in the conventional nonhydraulic manner.

Both tension levers are the same. They must be very rigid and have been stamped to create an offset bend 179 of one half the thickness of the lever itself. This assures the centering of the pressure point on the piston. Each tension lever has a choice of three holes 180,181 or 182 in which the tension rod may be hooked into. The hole 180 nearest to the pivot stud will produce the greatest tension transferred to the tension rod with an equal amount of pressure in the cylinder. Hole 181 produces a lesser force than hole 180 and hole 182 produces the force. This is important because it allows five different ratios of top head to bottom head tension. These ratios remain the same as long as the hole that is used is not changed around the perimeter of each individual head. This allows each head to remain in perfect balance with itself while being different from the other head on the same drum. The tension rod 137 has a 90° angled bend that produces a right angled shaft 183 on the tension lever end. This shaft is then fitted with a friction knob 184 that is snapped into one of the three holes in the tension lever. The friction knob fits tight enough in the hole so that it can not come out of the hole under normal operations. It is removed from the hole by levering it out with a screwdriver or other lever.

A conventional tension screw 138 is put through a corresponding hole in a conventional drum pressure rim and screwed into the internally threaded end of the tension rod. It is adjustable so that under extreme head conditions the hydraulic units can all be kept in their free floating range. A tension lever retracting spring 185 is hooked into holes 186 to keep all slack out of the system. The slave cylinder is fitted with a standard automotive type bleed screw 187 to purge air from each cylinder in successive order from the master cylinder to the last slave cylinder on the end of the line. Held in place by the bleed screw is a leaf spring 188 that holds the hydraulic unit cover 136 in place. Two flanges 189 are formed as part of the slave cylinder casing through which short bolts and nuts 190 fasten the cylinder through the backing plate and to the drum shell, consequently holding the backing plate in place. Even through there is little or no sideways pressure on the cylinder as long as the gaps 179 remain, the mounting must be of sufficient strength to keep the cylinder stationary even if only one head is mounted and tensioned by the tension screws only. The backing plate has rectangular stop block mounting holes 191 that have the side away from the tension lever stamped and raised away from the drum shell to form a socket. The stop blocks 192 have a groove cut into the side away from the tension lever so that when they are pushed down into the rectangular hole they are slide away from the tension lever and lock into place with the raised side of the backing plate hole tight in the stop block groove. In addition to the stop block keeping the tension lever from going too far and allowing the piston and seal from coming out of the cylinder, the stop block also allows the drum to function under normal hydraulic balancing conditions when only one head is installed on the drum.

Besides the stamped raised socket behind the stop blocks, there are four stamped raised catches on the edges of the backing plate. Two at 193 and two at 194 which correspond to four 90° angled tabs, two at 195 and two at 196, on the back edges of the hydraulic unit cover (see FIG. 11). The two tabs labeled 195 project twice as far as the two tabs labeled 196. To install the cover, tabs 195 are started in their respective slots 193 behind the backing plate with the cover angled out away from the backing plate. The cover is then pushed left compressing the leaf spring 188 being held in place by the bleeder screw 187 on the slave cylinder, then pushed back in line with the backing plate. When released, the leaf spring pushes the cover to the right, sliding tabs 196 into the slots 194 behind the backing plate.

Accurate gauge tuning is accomplished by the addition of a gauge (see FIG. 12) to measure the hydraulic pressure in the circuit. The gauge functions normally whether the "T" handle master cylinder or an additional pedal operated master cylinder is used to initiate the change.

Figure 13:
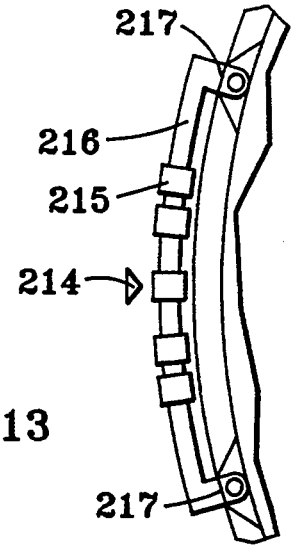
FIG. 13 shows the external tuning gauge visual dial and indicators.

The gauge consists of an externally mounted cylinder 197 and cover 218 that is held in place either with integral eyelets 198 cast onto the cylinder or pipe style straps. Bolts 199 pass through the backing plate 200 and on through the drum shell holding the entire unit in place. The cylinder has a bleeder screw 201, and a entrance port 202 that is threaded to accept the hydraulic tubing fitting. The hydraulic fluid connection can be made anywhere in the circuit as long as all cylinders remain in a straight line with no loops created. The system must be purged from the master cylinder where it is filled to each successive cylinder in order. The tuning gauge slave cylinder has a thick cap 203 that is threaded onto the end and has a keyed guide hole 204 that the keyed push rod 205 slides through. The internal end of the push rod is fastened to the piston 206 which in turn presses on the seal 207 and consequently the fluid 208 in the chamber. Inside the cylinder between the end cap and the piston is a compression spring 209 against which the changing fluid pressure pushes. The upper end of the sliding push rod has an internally threaded hold 210. A screw 211 with a rolling sleeve are installed in the hole and through a slot in the "L" shaped lever 212. As the sliding push rod goes up and down the screw and sleeve ride back and forth in the slot and rotates the "L" shaped lever around the pivot bolt 213. The upper leg of the "L" shaped lever has a pointer 214 at the tip that is bent at a 90° angle toward the drum shell (see FIG. 13). This pointer allows the user to repeat the sliding push rod position by visually lining up the pointer to any of the previously set manually adjustable indicators 215. The track 216 that holds the visual position indicators is held in place by the two tab eyelets 217 at its ends. These eyelets are clamped down under the washers held down by two adjacent tension screws 138.

Figure 14:
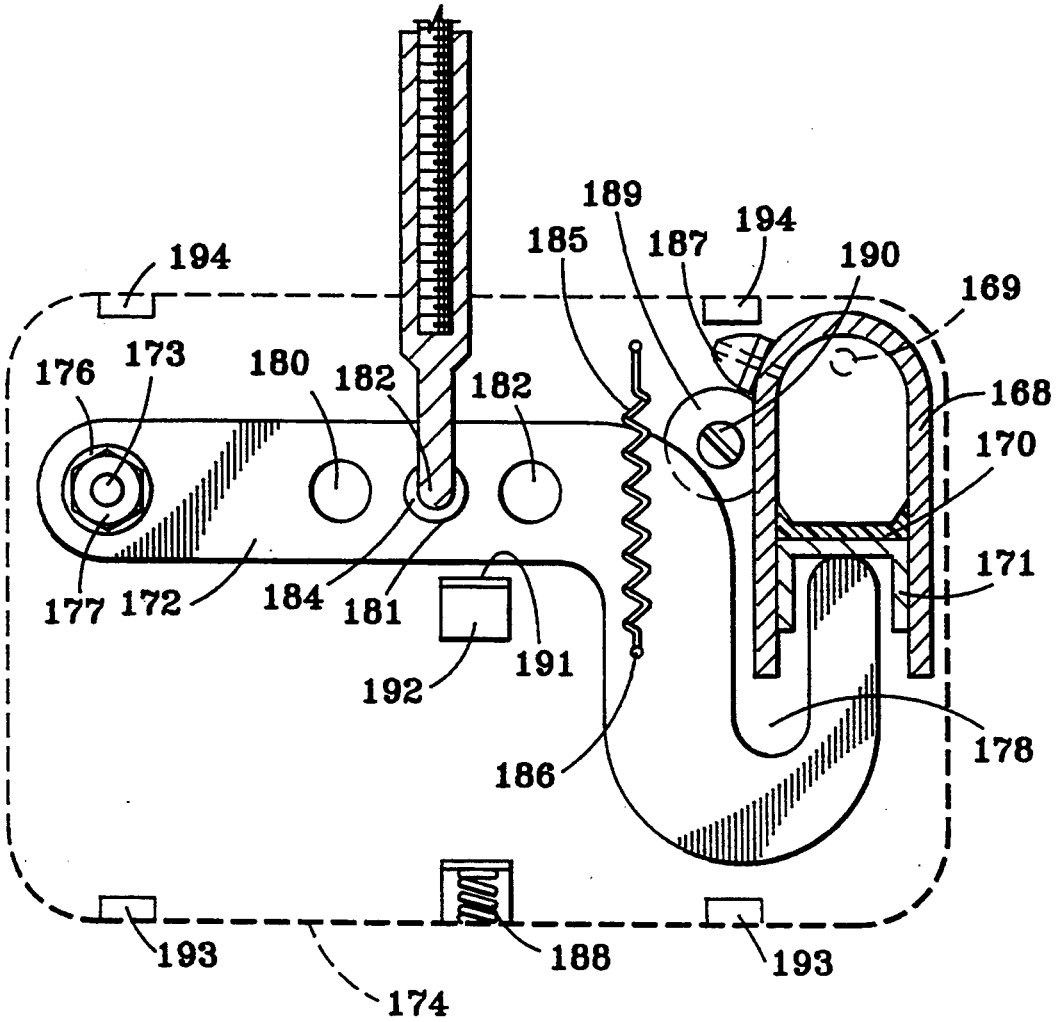
FIG. 14 shows an externally mounted hydraulic tension unit for installation on a single headed drum, but not exclusive to timpani.

FIG. 14 shows an externally mounted hydraulic tension unit for installation on a single headed drum, but not exclusive to timpani. The part numbers correspond to the part numbers for the externally mounted hydraulic tension unit for installation on a double headed drum in FIG. 10.

From the foregoing description, one skilled in the art can easily ascertain the essential characteristics of this invention, and without departing from the spirit and scope thereof, can make various changes and modifications of the invention to adapt it to various usages and conditions.

Accordingly, the scope of the invention should be determined not by the embodiments illustrated, but by the appended claims and their legal equivalents.

I claim:

1. A pressurized fluid system for adjusting the tension across a drumhead of a drum, comprising:

tension means disposed around the periphery of said drum head for applying a predetermined tension to said drum head;

actuator means coupled to said tension means for varying the tension applied by said tension means across said drum head;

means for providing a pressurized fluid to said actuator means, whereby, said actuator means varies said tension applied by said tension means in response to changes in said pressurized fluid;

a pressure rim connected to said tension means;

said tension means comprises a tensioning rod means and a means for adjustably positioning said tensioning rod means with respect to said pressure rim;

said actuator means comprises a piston means displaced with respect to said drum in response changes in said pressurized fluid;

lever means connected to said piston means and to said tension rod; and adjusting means disposed on said lever means for adjusting the magnitude of force applied to said tension means in response to the changes in pressurized fluid by changing the location along the lever means at which the tension rod means is connected to said lever means.

2. A pressurized fluid system for adjusting the tension across a drumhead of a drum, comprising:

tension means disposed around the periphery of said drum head for applying a predetermined tension to said drum head;

actuator means coupled to said tension means for varying the tension applied by said tension means across said drum head;

means for providing a pressurized fluid to said actuator means, whereby, said actuator means varies said tension applied by said tension means in response to changes in said pressurized fluid; and wherein said pressurized fluid providing means comprises a pressure input means for inputting a pressure change to said pressurized fluid.

3. A drum tension system according to claim 2, wherein:

said means for providing said pressurized fluid and said actuator means are disposed inside or outside of said drum.

4. A drum tension system according to claim 2, wherein, said actuator means includes a lever means for applying a predetermined force to said tension means in response to changes in said pressurized fluid.

5. A drum tension system according to claim 4, wherein, said lever means further comprises adjusting means for adjusting the magnitude of force applied to said tension means in response to the changes in pressurized fluid.

6. A drum tension system according to claim 2, wherein, said tension means comprises a tensioning rod means for displacing said drum head with respect to said drum.

7. A drum tension system according to claim 2, wherein, said tension means includes a releasable connecting means to releasably connect said tension means to said actuator means, whereby, said drum head and tension means may be removed from said drum allowing said drum head to be changed.

8. A drum tension system according to claim 2, wherein, said pressure input means comprises at least one of a foot pedal, T-handle, or crank.

9. A drum tension system according to claim 2, further comprising:

a flexible hose connected to said pressure input means, whereby, said pressure input means may be conveniently placed with respect to said drum.

10. A drum tension system according to claim 2, wherein, said pressurized fluid providing means further comprises a master cylinder means and a pressurized fluid circulation means;

said master cylinder means being connected between said pressure input means and said pressurized fluid circulating means for inputting pressure changes from said pressure input means to said pressurized fluid, and said circulation means being connected to said actuator means to transfer said pressure changes from said master cylinder to said actuator means.

11. A drum tension system according to claim 10, wherein:

said actuator means, said master cylinder means, and/or said pressurized fluid circulation means are disposed inside or outside of said drum.

12. A drum tension system according to claim 10, wherein, said actuator means comprises a plurality of slave cylinders connected to said pressurized fluid circulation means.

13. A pressurized fluid system for adjusting the tension across each drumhead on a drum having two opposing drumheads, comprising:

tension means being disposed around the periphery of each drum head for applying a predetermined tension to each drum head;

actuator means coupled to said tension means for varying the tension applied by said tension means across each of said drum heads;

means for providing a pressurized fluid to said actuator means, whereby, said actuator means varies said tension applied by said tension means in response to changes in said pressurized fluid, and wherein said pressurized fluid providing means comprises a pressure input means for inputting a pressure change to said pressurized fluid.

14. A drum tension system according to claim 13, wherein, said pressurized fluid providing means further comprises a master cylinder means and a pressurized fluid circulation means;

said master cylinder means being connected between said pressure input means and said pressurized fluid circulating means for inputting pressure changes from said pressure input means to said pressurized fluid, and said circulation means being connected to said actuator means to transfer said pressure changes from said master cylinder to said actuator means.

15. A drum tension system according to claim 14, wherein:

said actuator means, said master cylinder means, and/or said pressurized fluid circulation means are disposed inside or outside of said drum.

16. A drum tension system according to claim 13, wherein:

said means for providing said pressurized fluid and said actuator means are disposed inside or outside of said drum.

17. A drum tension system according to claim 13, wherein, said drum includes a pressure rim corresponding to each drumhead; each of said pressure rims being connected to said tension means;

said tension means displacing each of said pressure rims with respect to said drum to vary tension across the drumhead.

18. A drum tension system according to claim 13, wherein, said tension means includes a releasable connecting means to releasably connect said tension means to said actuator means, whereby, either of said drumheads and corresponding tension means may be removed from said drum allowing a drumhead to be changed.

19. A drum tension system according to claim 13, wherein, said pressure input means comprises at least one of a foot pedal, T-handle, or crank.

20. A drum tension system according to claim 13, further comprising:

a flexible hose connected to said pressure input means, whereby, said pressure input means may be conveniently placed with respect to said drum.

21. A pressurized fluid system for adjusting the tension across each drumhead on a drum having two opposing drumheads, comprising:

tension means being disposed around the periphery of each drum head for applying a predetermined tension to each drum head;

actuator means coupled to said tension means for varying the tension applied by said tension means across each of said drum heads;

means for providing a pressurized fluid to said actuator means, whereby, said actuator means varies said tension applied by said tension means in response to changes in said pressurized fluid; and adjusting means connected between said actuator means and said tension means for adjusting the magnitude of force applied by said tension means to a respective drumhead, said adjusting means transferring a first variable force to said tension means for one drumhead and a second variable force to said tension means for the other drumhead, said adjusting means producing said first and second variable forces in response to a common pressurized fluid change in said actuator means, whereby, varying ratios of the tension of one drumhead to the tension of another drumhead may be obtained.

22. A drum tension system according to claim 21, wherein, said adjusting means comprises a lever means; said lever means being connected to said tension means and said actuator means for applying a predetermined force to said tension means in response to said actuator means.

23. A pressurized fluid system for adjusting the tension across each drumhead on a drum having two opposing drumheads, comprising:

tension means being disposed around the periphery of each drum head for applying a predetermined tension to each drum head;

actuator means coupled to said tension means for varying the tension applied by said tension means across each of said drum heads;

means for providing a pressurized fluid to said actuator means whereby said actuator means varies said tension applied by said tension means in response to changes in said pressurized fluid; and wherein said actuator means comprises a slave cylinder means connected to said means for providing said pressurized fluid and to both drumheads; and said slave cylinder means comprising a plurality of slave cylinders; each slave cylinder comprising two piston means each piston means being connected to said tension means for a respective drumhead.

24. A pressurized fluid system for adjusting the tension across a drumhead of a drum, comprising:

tension means disposed around the periphery of said drum head for applying a predetermined tension to said drum head;

actuator means coupled to said tension means for varying the tension applied by said tension means across said drum head;

means for providing a pressurized fluid to said actuator means, whereby, said actuator means varies said tension applied by said tension means in response to changes in said pressurized fluid; and indicator means responsive to changes in the pressurized fluid for indicating said pressurized fluid condition.

25. A pressurized fluid system for adjusting the tension across each drumhead on a drum having two opposing drumheads, comprising:

tension means being disposed around the periphery of each drum head for applying a predetermined tension to each drum head;

actuator means coupled to said tension means for varying the tension applied by said tension means across each of said drum heads;

means for providing a pressurized fluid to said actuator means, whereby, said actuator means varies said tension applied by said tension means in response to changes in said pressurized fluid; and indicator means responsive to changes in the pressurized fluid for indicating said pressurized fluid condition.

26. A pressurized fluid system for adjusting the tension across a drumhead of a drum, comprising:

tension means disposed around the periphery of said drum head for applying a predetermined tension to said drum head;

actuator means coupled to said tension means for varying the tension applied by said tension means across said drum head;

means for providing a pressurized fluid to said actuator means, whereby, said actuator means varies said tension applied by said tension means in response to changes in said pressurized fluid; and limiting gap means disposed to limit movement of said tension means, whereby said tension means may be adjusted to tune said drumhead even in the absence of said pressurized fluid.

27. A pressurized fluid system for adjusting the tension across each drumhead on a drum having two opposing drumheads, comprising:

tension means being disposed around the periphery of each drum head for applying a predetermined tension to each drum head;

actuator means coupled to said tension means for varying the tension applied by said tension means across each of said drum heads;

means for providing a pressurized fluid to said actuator means, whereby, said actuator means varies said tension applied by said tension means in response to changes in said pressurized fluid; and limiting gap means disposed to limit movement of said tension means, whereby said tension means may be adjusted to tune each said drumhead even in the absence of said pressurized fluid.

* * * * *